United States Patent [19]

Yamazaki et al.

[11] 4,067,192

[45] Jan. 10, 1978

[54] EXHAUST MANIFOLD FOR INTERNAL COMBUSTION ENGINE

[75] Inventors: Shuichi Yamazaki, Kamifukuoka; Ikuo Kajitani, Niiza, both of Japan

[73] Assignee: Honda Giken Kogyo Kabushiki Kaisha, Tokyo, Japan

[21] Appl. No.: 679,365

[22] Filed: Apr. 22, 1976

[30] Foreign Application Priority Data

| | | |
|---|---|---|
| Apr. 30, 1975 | Japan | 50-52777 |
| Apr. 30, 1975 | Japan | 50-52778 |
| Apr. 30, 1975 | Japan | 50-59163[U] |
| Apr. 30, 1975 | Japan | 50-59164[U] |

[51] Int. Cl.[2] ..... F01N 3/10

[52] U.S. Cl. ..... 60/282; 60/323; 123/122 AB

[58] Field of Search ..... 60/282, 323, 322; 123/122 AB

[56] References Cited

U.S. PATENT DOCUMENTS

| | | | |
|---|---|---|---|
| 3,756,027 | 9/1973 | Gotoh | 60/323 |
| 3,839,862 | 10/1974 | Gota | 60/323 |
| 3,940,927 | 3/1976 | Maurhoff | 60/282 |
| 3,969,893 | 7/1976 | Sakurai | 60/282 |

*Primary Examiner*—Douglas Hart
*Attorney, Agent, or Firm*—Lyon & Lyon

[57] ABSTRACT

An exhaust manifold for a multi-cylinder internal combustion engine is provided with preliminary oxidation reaction chambers, each of which receives exhaust gases from exhaust port liners each serving a pair of adjacent cylinders of different exhaust timing. These preliminary oxidation reaction chambers each communicate downstream with a main oxidation reaction chamber subdivided into a plurality of concentric subchambers. The subchambers enclose the preliminary oxidation reaction chambers and exhaust gas inlet pipes. Combustion of unburned hydrocarbons (HC) is principally accomplished in the preliminary oxidation reaction chambers, and the exhaust gases are maintained at relatively high temperature and retained for a sufficient period of time in the subchambers to accomplish oxidation of the unburned carbon monoxide (CO).

6 Claims, 8 Drawing Figures

FIG. 4.
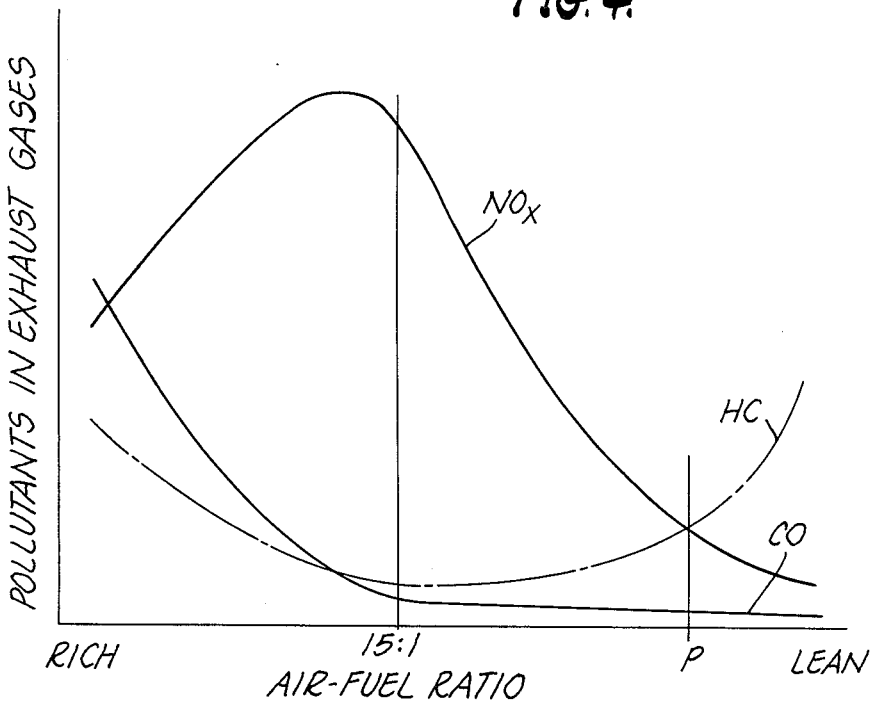
FIG. 5.
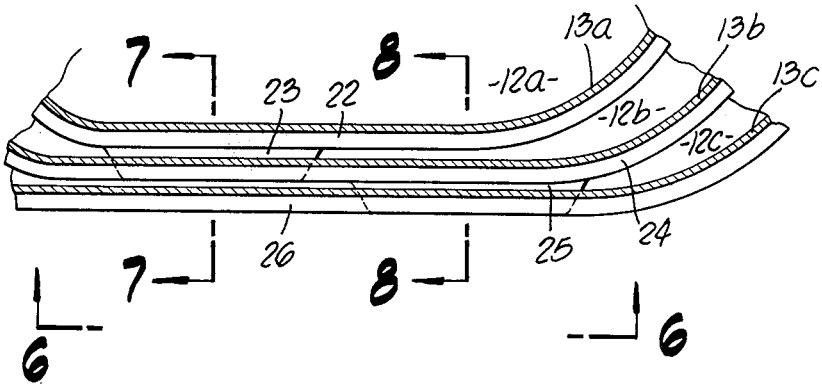
FIG. 7.
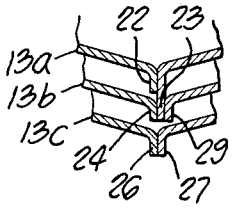
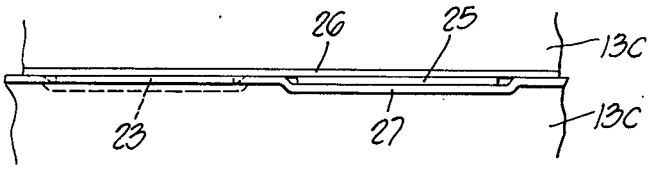
FIG. 6.
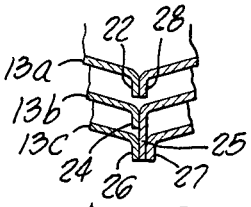
FIG. 8.

EXHAUST MANIFOLD FOR INTERNAL COMBUSTION ENGINE

This invention relates to an exhaust manifold for an internal combustion engine which operates with an air-fuel mixture leaner than stoichiometric and which, therefore, has an excess of high temperature oxygen in the exhaust gases simultaneously to reduce and minimize the pollutant components in the exhaust gas HC and CO. This high temperature oxygen in used to burn unburned components of the hydrocarbons (HC) and to oxidize CO in the exhaust gases to $CO_2$, by maintaining the exhaust gases at a relatively high temperature for a relatively long period of time. In the general plan of operation, exhaust gas is fed from pairs of adjacent cylinders having different exhaust timing through exhaust port liners and directly into preliminary oxidation reaction chambers for combustion of the unburned hydrocarbons principally. The exhaust gases then pass from the preliminary oxidation reaction chambers into a main oxidation reaction chamber subdivided into a plurality of concentric subchambers and passed successively through them. The hot exhaust gases are retained within the subchambers for sufficient time to convert most of the CO to $CO_2$.

The present invention is intended to further decrease the degree of contamination of exhaust gas, and to this end, the air-fuel ratio delivered by the carburetor to the cylinders is set so lean as to approach the combustibility limit to reduce the quantities of NOx first. This, however, involves a problem. That is, the absolute quantities of HC and CO are far smaller than those in the ordinary so-called rich engines in which the air-fuel mixture is richer than the stoichiometric air-fuel ratio. If it is attempted to oxidize HC and CO by providing an exhaust gas reaction chamber or chambers as usually employed with such a rich engine, sufficient exotherm energy is not available to effectuate the desired combustion reactions in the exhaust gas. The present invention has for its object the provision of an improved exhaust manifold which permits further rarefaction of the air-fuel mixture and which is also capable of largely eliminating, through oxidation, the concomitantly increasing HC as well as CO which exists in relatively small quantity.

Other and more detailed objects and advantages will appear hereinafter.

In the drawings:

FIG. 4 is a graphic diagram showing the relationship between the air-fuel ratio and the production of pollutants $NO_x$, HC, and CO in the exhaust gases.

FIG. 5 is an enlargement of portions of FIG. 3.

FIG. 6 is a view partly broken away, taken in the direction of the lines 6—6 as shown in FIG. 5.

FIG. 7 is a sectional detail taken substantially on the lines 7—7 as shown in FIG. 5.

FIG. 8 is a sectional detail taken substantially on the lines 8—8 as shown in FIG. 5.

Figure 1:
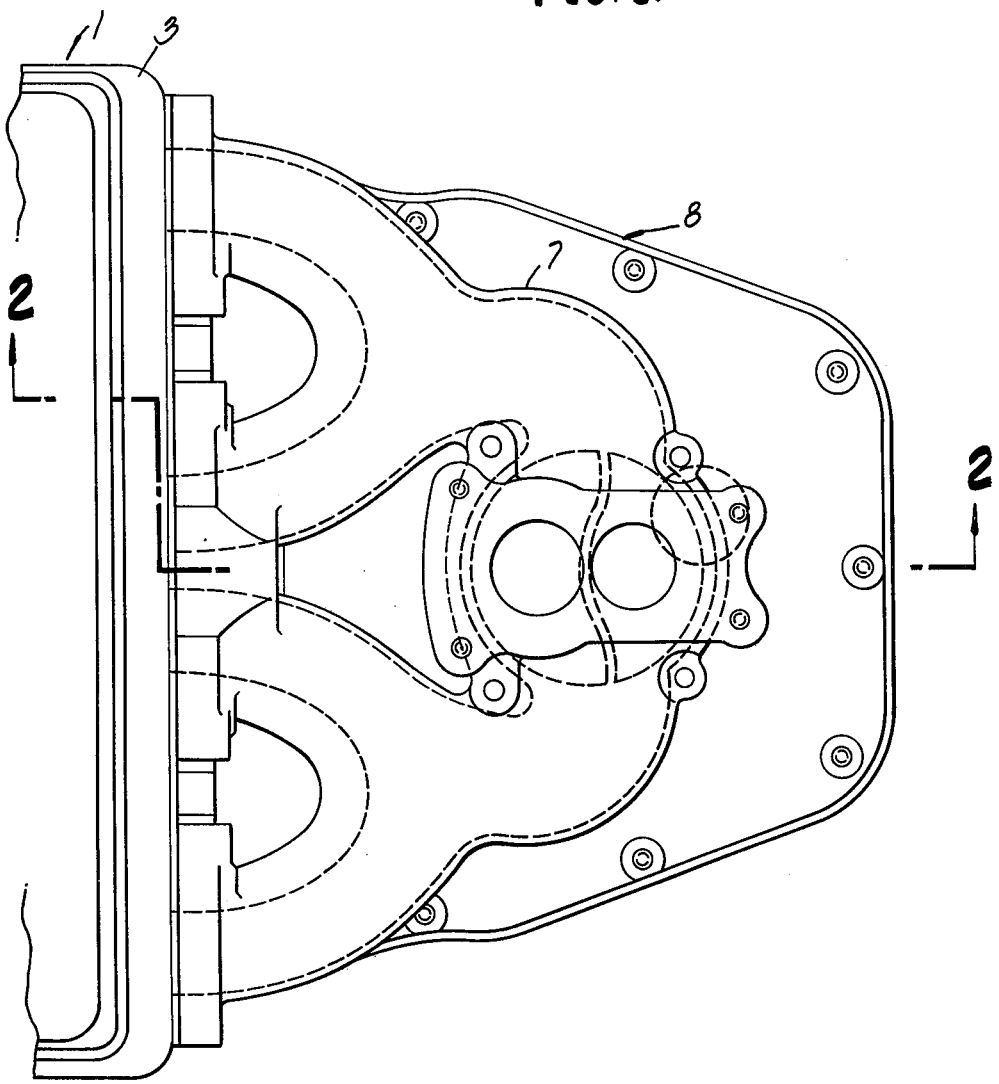
FIG. 1 is a top plan view showing a preferred embodiment of this invention.
Figure 2:
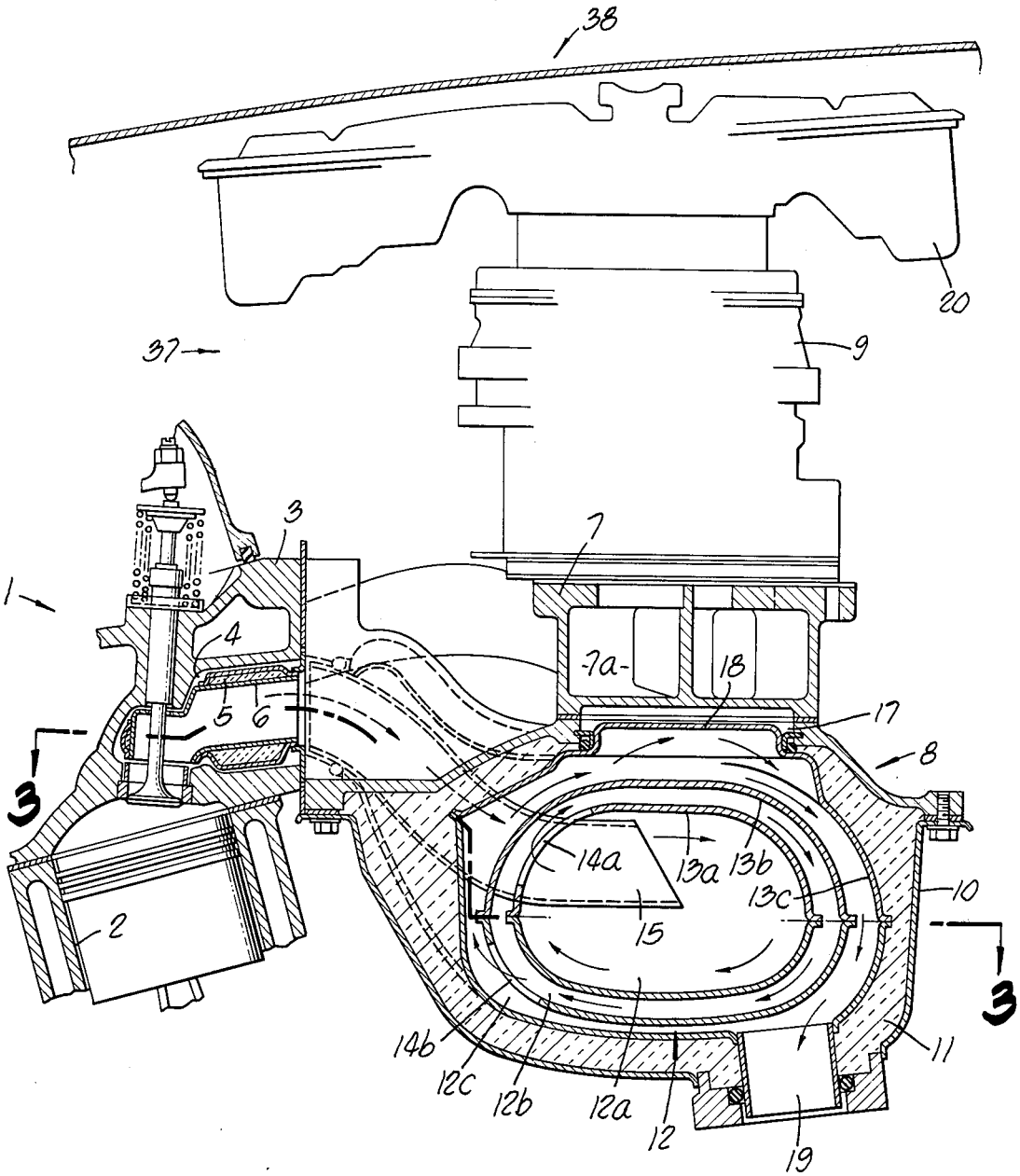
FIG. 2 is a side elevation partly in section, taken in the lines 2—2 as shown in FIG. 1.
Figure 3:
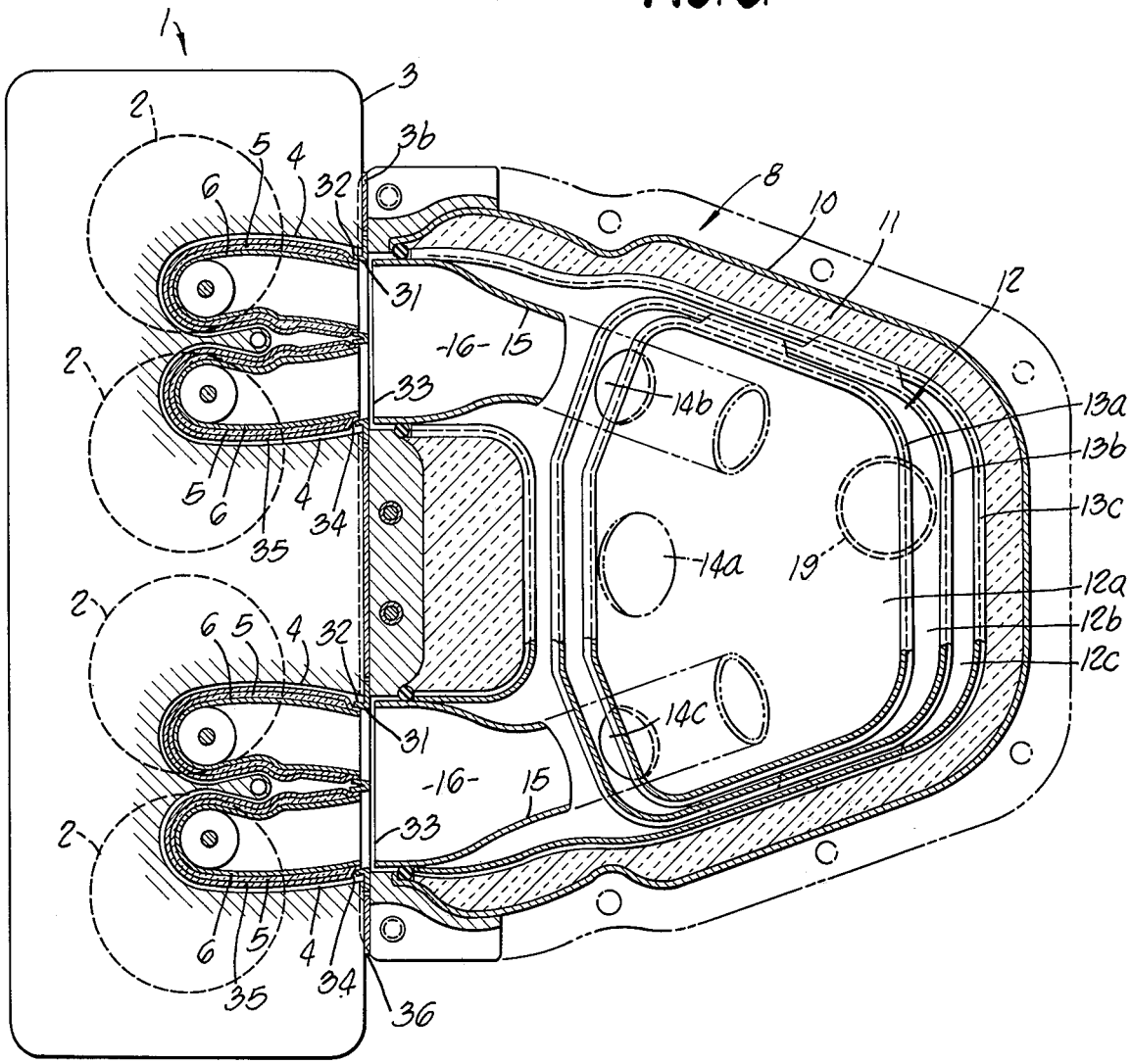
FIG. 3 is a sectional view taken substantially on the lines 3—3 as shown in FIG. 2.

Referring to the drawings, the internal combustion engine generally designated 1 is provided with four cylinders 2. The cylinder head 3 is provided with intake ports (not shown) and exhaust ports 4. The exhaust ports 4 are arranged in juxtaposition to make two pairs, and each of the ports 4 is provided with a port liner 6 coated with heat-insulating material 5 so as to minimize heat dissipation of exhaust gases passing through the cylinder head 3.

An intake manifold 7 and an exhaust manifold 8 are joined to the same side of the cylinder head 3 where the intake ports and exhaust ports 4 open. At the upstream end of the intake manifold 7 is mounted a carburetor 9 for supplying a lean mixture to the respective cylinders 2 through the intake manifold 7. This carburetor 9 is designed to set the air-fuel ratio of the mixture at a value close to the combustible limit on the lean side of the equilibrium point *p* in FIG. 4.

The exhaust manifold 8 has a main oxidation reaction chamber 12 enclosed by a layer of heat-insulating material 11 in the outer shell 10. The reaction chamber 12 is compartmented by three concentrically arranged and substantially oval sectioned inner shells 13*a*, 13*b*, 13*c* into three subchambers: a centrally positioned first main oxidation reaction subchamber 12*a* , a second main oxidation reaction subchamber 12*b* surrounding said subchamber 12*a*, and a third main oxidation reaction subchamber 12*c* surrounding said second subchamber 12*b*. Said first and second main oxidation reaction subchambers 12*a* and 12*b* communicate with each through a first exhaust opening 14*a* formed centrally in the upper part of the front side of the first inner shell 13*a*, while the second and third main oxidation reaction subchambers 12*b* and 12*c* communicate with each other through a pair of second exhaust openings 14*b* formed near each end of the lower part of the front side of the second inner shell 13*b*. The outlet ends of two exhaust gas inlet pipes 15 open into the first main oxidation reaction subchamber 12*a*. The pipes 15 extend through both ends of the upper part of the front side of each of said inner shells 13*a*, 13*b*, 13*c*, with each of said exhaust gas inlet pipes 15 communicating with the corresponding pair of exhaust ports 4 without contacting the cylinder head 3. The axes of the cutlet ends of said pipes 15 extend tangentially of the peripheral surface of the first main oxidation reaction subchamber 12*a* and are inclined relative to each other toward the first exhaust opening 14*a* in the first inner shell 13*a* in the developed state of the first inner shell 13*a*.

The wall surfaces of said respective inner shells 13*a*, 13*b*, 13*c*, and the outlet ends of the pipes 15 and the exhaust openings 14*a*, 14*b* have such a configuration that the angle of reversal of the exhaust gas flow in the respective main oxidation reaction subchambers 12*a*, 12*b* and 12*c*, will be at 90° to 270° so as to produce smooth swirling flows of exhaust gas in the respective subchambers without increasing exhaust backpressure. The single opening 14*a* is misaligned with both of the spaced openings 14*b*.

Each of the exhaust gas inlet pipes 15 is provided with a preliminary oxidation reaction chamber 16 which is bulged on the inlet side and is in direct communication with the corresponding pair of exhaust ports 4. This preliminary oxidation reaction chamber 16 is designed to principally burn HC in the exhaust gases, which HC is the unburned component having a low combustion temperature. It is required that the volume of this preliminary oxidation reaction chamber 16 be large enough insure a sufficient retention time of exhaust gas for perfecting proper combustion of HC, but it is also required that said volume be small enough to shorten the warm-up time until the activation temperature in the reaction chamber 16 is attained. It has been experimentally determined that these two contradictory requirements can be met by designing each of the preliminary oxidation reaction chambers 16 such that its volume is from 0.05 to 0.40 times the sum of the stroke volumes of all of the cylinders 2 which are connected to the preliminary oxidation reaction chamber. In the embodiment shown, two cylinders are connected to each preliminary oxidation reaction chamber.

The front side of the third inner shell 13*c* is bulged so that the third main oxidation reaction subchamber 12*c* encloses the preliminary oxidation reaction chambers 16 and exhaust gas inlet pipes 15. The top of the third inner shell 13*c* is also bulged to form a heating section 18 which is exposed to the underside of a branched portion 7*a* of the intake manifold 7 through an opening 17 formed in the upper part of the outer shell 10. It will also be seen that an exhaust gas outlet pipe 19 is joined to a rear part of the bottom of said third inner shell 13*c*. The exhaust gas outlet pipe 19 is adapted for connection to a silencer (not shown). The air cleaner 20 is attached to the carburetor 9.

The outer shell 10 and the inner shells 13*a*, 13*b*, 13*c* are concentric and they all have a vertically compressed configuration so that a compact exhaust manifold is obtained which is relatively short in vertical height. Such a manifold can be easily installed even in the crowded engine compartment 37 of an automobile having a low-positioned hood or bonnet 38.

As best shown in FIGS. 5–8, each of the first, second and third shells 13*a*, 13*b*, 13*c* consists of upper and lower parts which are integrally fixed to each other at flange-like bonding edges 22 and 28, 24 and 29 and 26 and 27 by welding or the like. First supporting tongue members 23 are integrally formed on one flange-like bonding edge 28 of the first shell 13*a* to extend therefrom. These first supporting tongue members 23 are integrally bonded and clamped between the flange-like bonding edges 24 and 29 of the second shell 13*b*, so that the first shell 13*a* can be supported by the second shell 13*b*. Similarly, the second supporting tongue members 25 are integrally formed on one flange-like bonding edge 29 of the second shell 13*b* to extend therefrom, and these second supporting tongue members 25 are bonded and clamped between flange-like bonding edges 26 and 27 of the third shell 13*c*, whereby the second shell 13*b* is supported by the third shell 13*c*. The third shell 13*c* is directly supported by the outer shell 10. The positions of the first and second supporting tongue members 23 and 25 are separated from each other, so that escape of thermal energy of exhaust gases flowing in the exhaust gas oxidation chambers 12*a*, 12*b* to the outer shell 10 through the exhaust gas oxidation chamber 12*c* by heat conduction through the first and second tongue members 23 and 25 can be reduced as much as possible.

A supporting plate 31 is provided for each adjacent pair of exhaust port liners 6. Each supporting plate 31 has internal lips 32 defining a pair of apertures aligned with the entrance opening 33 in one of the gas inlet pipes 15. The internal lips 32 engages and are fixed to the discharge end 34 of the outer wall 35 of the port liner 6, and the flat portion of the supporting plate 31 is aligned with the gasket 36 and is clamped between the cylinder head 3 and the exhaust manifold 8.

In operation, the engine 1 burns a lean mixture supplied from the carburetor 9, and accordingly high temperature excess oxygen remains in substantial quantities in the exhaust gases. Such high temperature excess oxygen proves conducive to combustion and oxidation of HC and CO in the exhaust gases.

Exhaust gases from the combustion chambers of the engine pass through the exhaust port liner 6 into the preliminary oxidation reaction chambers 16. The exhaust gases from each adjacent pair of cylinders 2 are alternately introduced into each reaction chamber 16, because of the different valve timing of the engine. Since such alternate exhaust gas introduction interval is very short, and since the exhaust gas inlet pipes 15 which define the respective preliminary oxidation reaction chambers 16 are not in contact with the cylinder head 3, which is relatively low in temperature, the reaction chambers 16 are heated quickly by exhaust gases, allowing rapid attainment of the activation temperature after start-up of the engine 1. In the activated preliminary oxidation reaction chambers 16, the unburned component of HC with low combustion temperature in exhaust gas is burned, whereby the exhaust gas is further elevated in temperature and then transferred into the first main oxidation reaction subchamber 12*a* through the respective exhaust gas inlet pipes 15. Upon entering the first main oxidation reaction subchamber 12*a*, the exhaust gas is caused to swirl as shown by the arrows in said subchamber because of the position and direction of the outlet ends of said exhaust gas inlet pipes 15. The exhaust gas then flows into the second main oxidation reaction subchamber 12*b* through the first exhaust opening 14*a* while making a similar swirling movement therein, and thence to the third main oxidation reaction subchamber 12*c* through the pair of second exhaust openings 14*b*, where a similar swirling flow of exhaust gas is continuously produced. During this process, the exhaust gas flow passing the opening 14*a* is not short-circuited directly into the opening 14*b* because the first and second exhaust openings 14*a* and 14*b* are offset with respect to each other, both vertically and laterally.

Such swirling flows of exhaust gas in said main oxidation reaction chamber 12 prolong the retention time of exhaust gas in said chamber 12 without inducing any appreciable rise of exhaust backpressure against the engine 1, and further, since the exhaust gas heated by preliminary combustion in the preliminary oxidation reaction chambers 16 is directly introduced into the first main oxidation reaction subchamber 12*a*, CO in the exhaust gas is oxidized to $CO_2$, and this occurs in the main oxidation reaction subchambers 12*a*, 12*b*, 12*c* regardless of the quantity of CO with relatively high oxidation temperature in the exhaust gas.

The swirling flows of exhaust gas in the second and third main oxidation reaction subchambers 12*b* and 12*c* play not only the role of effective high temperature heat-insulating layers for the respective interiorly-positioned reaction subchambers 12*a* and 12*b*, but also prove helpful in minimizing the temperature difference between the respective reaction subchambers 12*a*, 12*b*, 12*c*, so that the subchambers are always maintained at a high temperature condition to promote combustion and oxidation of the unburned components in the respective subchambers.

Further, as the swirling exhaust gas flow in the third main oxidation reaction subchamber 12*c* passes while contacting with the exteriors of the preliminary oxidation reaction chambers 16 and exhaust gas inlet pipes 15, said preliminary oxidation reaction chambers 16, when low in temperature, receive exhaust gas heat both interiorly and exteriorly and are quickly activated. When elevated in temperature, their exteriors are effectively kept at high temperature by exhaust gas flowing thereover. The exhaust gas flow also heats the heating section 18 at the top of the third inner shell 13*c*, the radiant heat emitted from said heating section 18 serving to heat the branched portion 7*a* of the intake manifold 7 to promote vaporization of the mixture passing through the branched portion 7*a* while equalizing mixture distribution to the respective cylinders 2. Although the exhaust gas which has heated the heating section 18 is lowered in temperature, no impediment results, as combustion of the earliest unburned components has already been completed at this stage. The exhaust gases with the CO and HC components substantially reduced or eliminated are then sent to the silencer, not shown, through the exhaust gas outlet pipe 19, and then released into the atmosphere.

In accordance with the present invention, there are two steps in the oxidizing reactions to minimize HC and CO in the exhaust gases. First, HC in the exhaust gas is burned in the preliminary oxidation reaction chambers 16 by effectively using exhaust gas heat. Next, CO is burned in the main oxidation reaction chamber 12 by utilizing HC combustion heat, thus realizing sure combustion of such unburned components in exhaust gases even if the quantities of such components may be small. Thus, even if the amount of HC produced in the exhaust gas is increased in proportion to rarefaction of the mixture, such increase can be well dealt with, and as a result all of the pollutant components in the exhaust gas, $NO_x$, HC and CO, are greatly reduced.

In another aspect of the present invention, the preliminary oxidation reaction chambers 16 and exhaust gas inlet pipes 15 are kept heated by exhaust gas in the main oxidation reaction chamber 12, so that the preliminary oxidation reaction chambers 16 are always maintained in a favorable activated condition. Exhaust gas suffers little drop of temperature during passage in the exhaust gas inlet pipes 15 to allow effective utilization of its heat for the oxidation reaction to occur in the next stage.

In still another aspect of this invention, the main oxidation reaction chamber 12 is compartmented into plural subchambers 12*a*, 12*b*, 12*c*, which are in successive communication, and the intake manifold 7 is heated by the exhaust gas which has undergone the oxidation reaction of the unburned components in the end-most reaction subchamber 12*c*, so that vaporization of the lean mixture and uniform distribution thereof to the respective cylinders 2 can be accomplished most efficiently and reliably without depriving the oxidation reaction heat of the unburned components on the upstream side, thus precluding any engine trouble resulting from improper distribution of the mixture.

In still another aspect of this invention, the first shell 13*a* is supported in properly spaced relationship by the enclosing second shell 13*b* through the use of the tongue members 23. Similarly, the second shell 13*b* is supported in properly spaced relationship within the enclosing third shell 13*c* by means of the second supporting tongue members 25.

Having fully described our invention, it is to be understood that we are not to be limited to the details herein set forth but that our invention is of the full scope of the appended claims.

We claim:

1. In combination, an internal combustion engine adapted to burn an air-fuel mixture leaner than stoichiometric so that excess oxygen is present in the exhaust gases, the engine having exhaust ports each provided with a liner insulated from the port walls, an exhaust manifold having a plurality of preliminary oxidation reaction chambers connected to receive exhaust gases directly from exhaust port liners, a main oxidation reaction chamber receiving exhaust gases from said preliminary oxidation reaction chambers, said main oxidation reaction chamber enclosing the major portion of said preliminary oxidation reaction chambers, said main oxidation reaction chamber comprising a first subchamber enclosed and surrounded by a second subchamber, said second subchamber being enclosed and surrounded by a third subchamber, a single opening establishing communication between the first subchamber and the second subchamber, spaced openings connecting the second subchamber and the third subchamber, said single opening and said spaced openings all being misaligned, means exposed to said third subchamber for heating an intake mixture supplied to the engine, and means for discharging gases from said third subchamber.

2. The combination set forth in claim 1 in which the port liners are spaced from the walls of the exhaust ports.

3. The device of claim 1 in which the discharge ends of said preliminary oxidation reaction chambers and said openings are so positioned and oriented as to cause swirling movement of exhaust gases in the same direction in all three subchambers.

4. In an exhaust manifold for an internal combustion engine, the improvement comprising, in combination: an exhaust gas inlet pipe connected to receive exhaust gases from exhaust ports of the engine, an oxidation reaction chamber including walls forming inner and outer chambers, each chamber being formed by two wall sections joined together at flange-like bonding edges, said inner chamber receiving exhaust gases from said exhaust gas inlet pipe, tongue members on the bonding edges of said walls forming the inner chamber, said tongue members being clamped between bonding edges on the walls forming the outer chamber, and means for discharging gases from said outer chamber.

5. In the exhaust manifold for an internal combustion engine, the improvement comprising, in combination: an exhaust gas inlet pipe connected to receive exhaust gases from exhaust ports of the engine, an oxidation reaction chamber, said oxidation reaction chamber including walls forming first, second and third chambers, said first chamber receiving exhaust gases from said exhaust gas inlet pipe, tongue members on said walls forming the first chamber, said tongue members being clamped between elements on the walls forming the second chamber, tongue members on said walls forming the second chamber, the latter tongue members being clamped between elements on the walls forming the third chamber, and means for discharging gases from said third chamber, the position of said first and second tongue members being separated from each other.

6. For use with an internal combustion engine adapted to burn an air-fuel mixture leaner than stoichiometric so that excess oxygen is present in the exhaust gases, an exhaust manifold, comprising, in combination: a plurality of pipes each forming a preliminary oxidation reaction chamber for burning HC, each preliminary chamber being connected to receive exhaust gases from exhaust ports of the engine, a main oxidation reaction chamber for oxidizing CO, said main chamber receiving exhaust gases from said preliminary oxidation reaction chambers, said main oxidation reaction chamber enclosing said preliminary oxidation reaction chambers, said main oxidation reaction chamber including walls forming first, second and third concentrically positioned subchambers, tongue members on said walls forming the first subchamber, said tongue members being clamped between elements on the walls forming the second subchamber, tongue members on said walls forming the second subchamber, the latter tongue members being clamped between elements on the walls forming the third subchamber, openings in said walls establishing communication between the first subchamber and the second subchamber and between the second subchamber and the third subchamber, respectively, and means for discharging gases from said third subchamber.

* * * * *